United States Patent [19]

Stucki

[11] 4,455,203

[45] Jun. 19, 1984

[54] PROCESS FOR THE ELECTROLYTIC PRODUCTION OF HYDROGEN PEROXIDE

[75] Inventor: Samuel Stucki, Baden, Switzerland

[73] Assignee: BBC Brown, Boveri & Company, Limited, Baden, Switzerland

[21] Appl. No.: 494,255

[22] Filed: May 13, 1983

[30] Foreign Application Priority Data

May 28, 1982 [CH] Switzerland ..... 3294/82

[51] Int. Cl.[3] ..... C25B 1/30

[52] U.S. Cl. ..... 204/84

[58] Field of Search ..... 204/84, 83; 423/584

[56] References Cited

U.S. PATENT DOCUMENTS

| | | | |
|---|---|---|---|
| 3,968,273 | 7/1976 | Kastening et al. | 204/84 |
| 3,969,201 | 7/1976 | Oloman et al. | 204/84 |
| 4,118,305 | 10/1978 | Oloman et al. | 204/83 |
| 4,384,931 | 5/1983 | Jasinski et al. | 204/84 |

*Primary Examiner*—R. L. Andrews
*Assistant Examiner*—Terryence Chapman
*Attorney, Agent, or Firm*—Oblon, Fisher, Spivak, McClelland & Maier

[57] ABSTRACT

Hydrogen peroxide, $H_2O_2$, is electrochemically produced from water or an aqueous solution and oxygen in an electrolytic cell using a solid electrolyte (1) made of a perfluorinated polymer and gas-permeable coatings (2,3) as electrodes by supplying the water to the anode side and the oxygen to the cathode side and withdrawing the $H_2O_2$ on the cathode side. In this process, the oxygen produced on the anode side can also be made use of by passing it round to the cathode side or passing it through the solid electrolyte (1) in any such case where no undesirable gas (for example chlorine) is simultaneously formed at the anode. The process works largely independently of the cation concentration (salts, bases) and does not require an additional separation of the $H_2O_2$ from a liquid electrolyte.

5 Claims, 6 Drawing Figures

PROCESS FOR THE ELECTROLYTIC PRODUCTION OF HYDROGEN PEROXIDE

Figure 1:
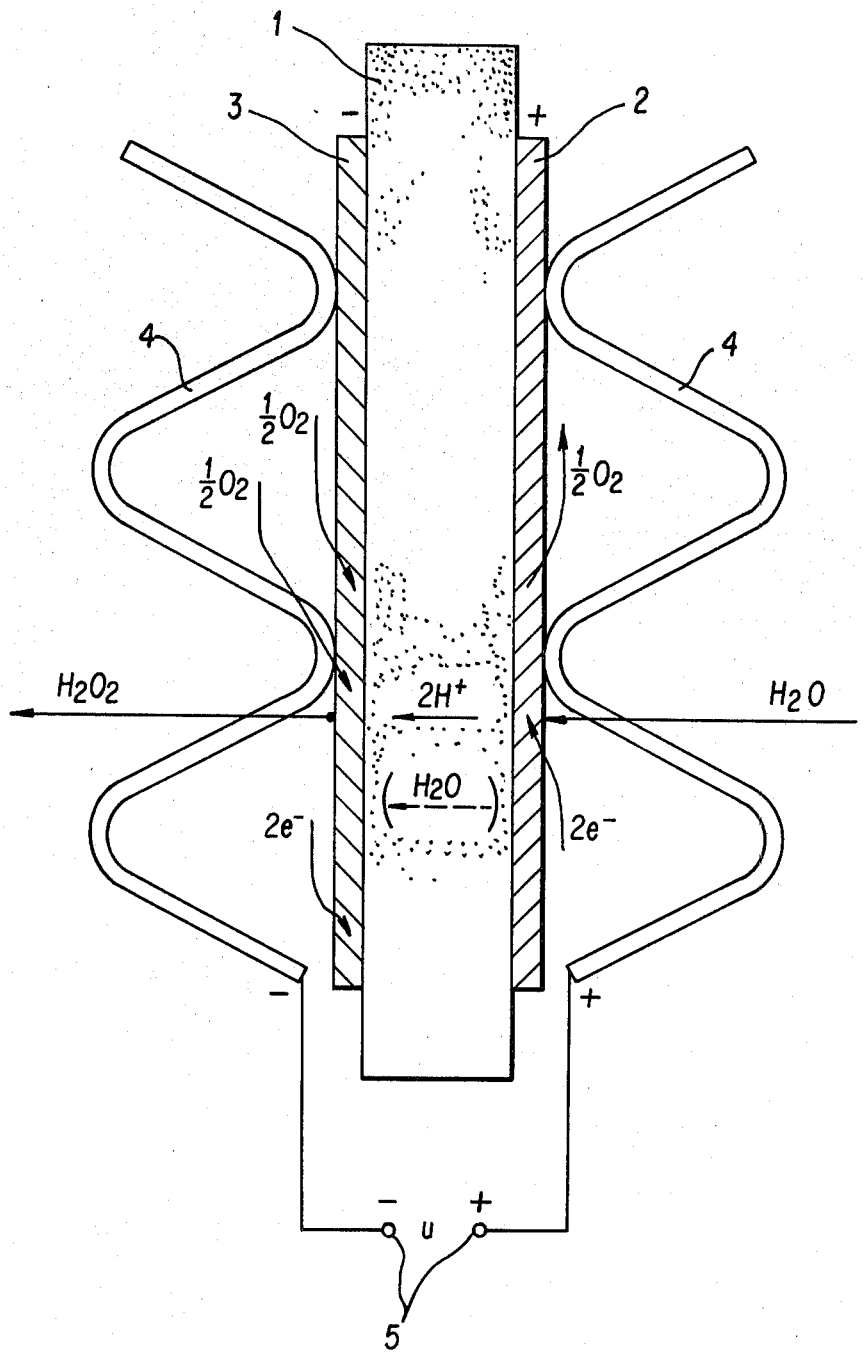

Today hydrogen peroxide is prepared either by the relatively old peroxodisulfuric acid process or the more recent anthraquinone process. In the first case, the consumption of electric energy alone is about 13,000 kwh and in the second case (involving the electrolytic production of hydrogen) about 3,000 kwh per tonne of hydrogen peroxide.

Hydrogen peroxide also forms in electrolytic cells, inter alia, under the condition that oxygen is present on the cathode side and that the cathode consists of carbon or any other material which favors the electrochemical reduction of oxygen to $H_2O_2$. The equation of the reaction is:

$$O_2+2H^++2e^-\rightarrow H_2O_2$$

In fuel cells, where, as is known, the aim is to reduce oxygen to water, this damaging reaction constitutes a particular problem.

It has already been proposed (B. Kastening and W. Faul, Herstellung von Wasserstoffperoxid durch kathodische Reduktion von Sauerstoff [Preparation of hydrogen peroxide by cathodic reduction of oxygen], Chemie Ingenieur Technik 49, 1977, No. 11, page 911) to use the above reaction together with various liquid electrolytes (for example potassium hydroxide solution or potassium chloride solution) for obtaining hydrogen peroxide. However, this method failed to establish itself on an industrial scale, since the $H_2O_2$ is produced in a concentration of only about 1–3% in an aqueous electrolyte from which it first needs to be separated. This separation gives rise to difficult problems. Machine and energy requirements are also considerable.

In view of the relatively high energy consumption of conventional industrial processes and in view of the technological difficulties in applying more recent processes involving the use of conventional liquid electrolytes, there is a clear need for more economical methods of producing hydrogen peroxide, of which the worldwide production in 1975 amounted to 500,000 tonnes.

It is an object of the invention to specify a process for preparing hydrogen peroxide $H_2O_2$, to give in a very economical and simple manner withouts technically complicated separating or purifying steps a product which can ideally be used direct in many fields.

This object is achieved by means of a process employing an electrolytic cell and involving the use of an $H_3O^+$— or $OH^-$—conducting solid electrolytes, porous, gas-permeable electrically conductive coatings as electrodes, and supplying the solid electrolyte with an aqueous solution, which may be independent of the cation concentration, along with an oxygen-containing gas or pure oxygen, and withdrawing from the cathode side the $H_2O_2$ produced thereby. The process, in a preferred embodiment, is practiced using an ion exchange membrane as the solid electrolyte, which may be a polymer film of a perfluorinated polymer having sulfonic acids and opposed coating acting as the anode, and cathode, respectively, which may be comprised of $IrO_2/RuO_2$-based electro catalyst as the anode and a charcoal powder as the cathode.

Figure 2:
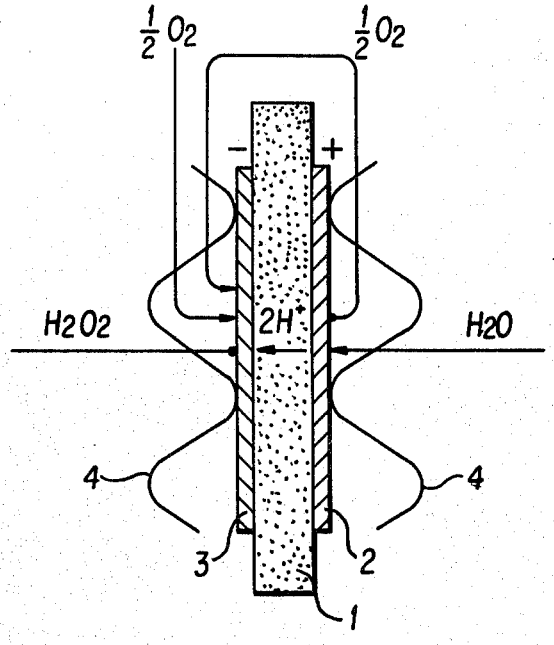
Figure 3:
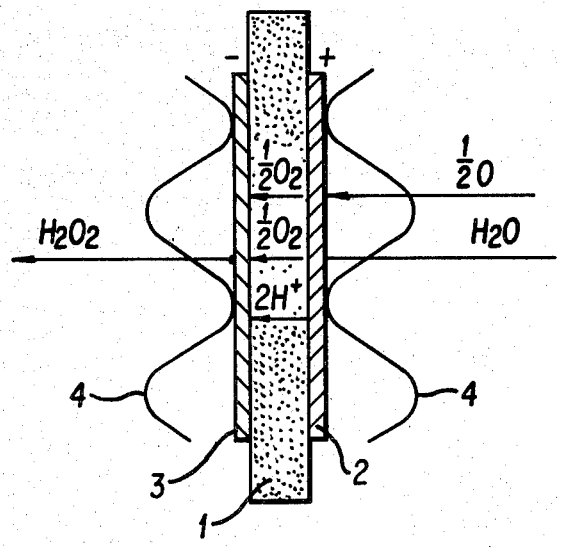
Figure 4:
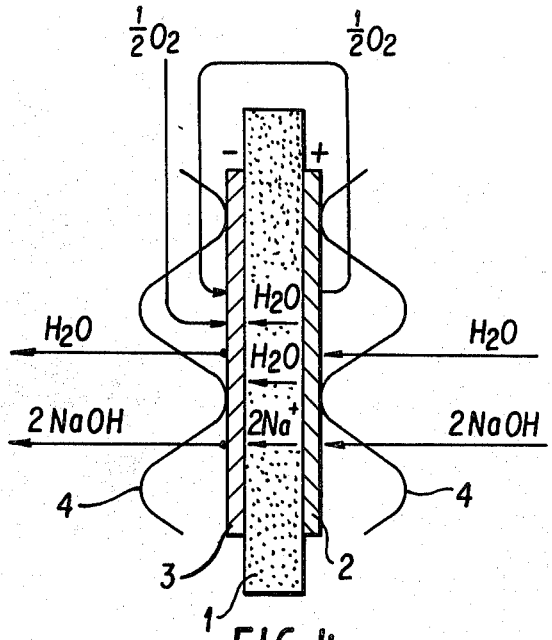
Figure 5:
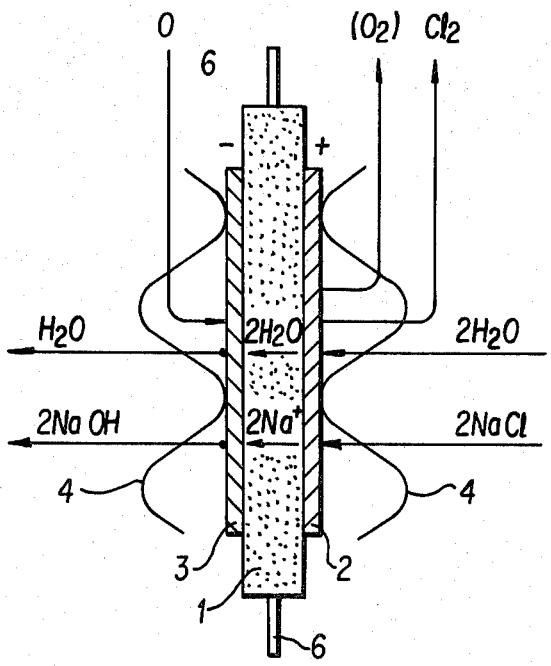
Figure 6:
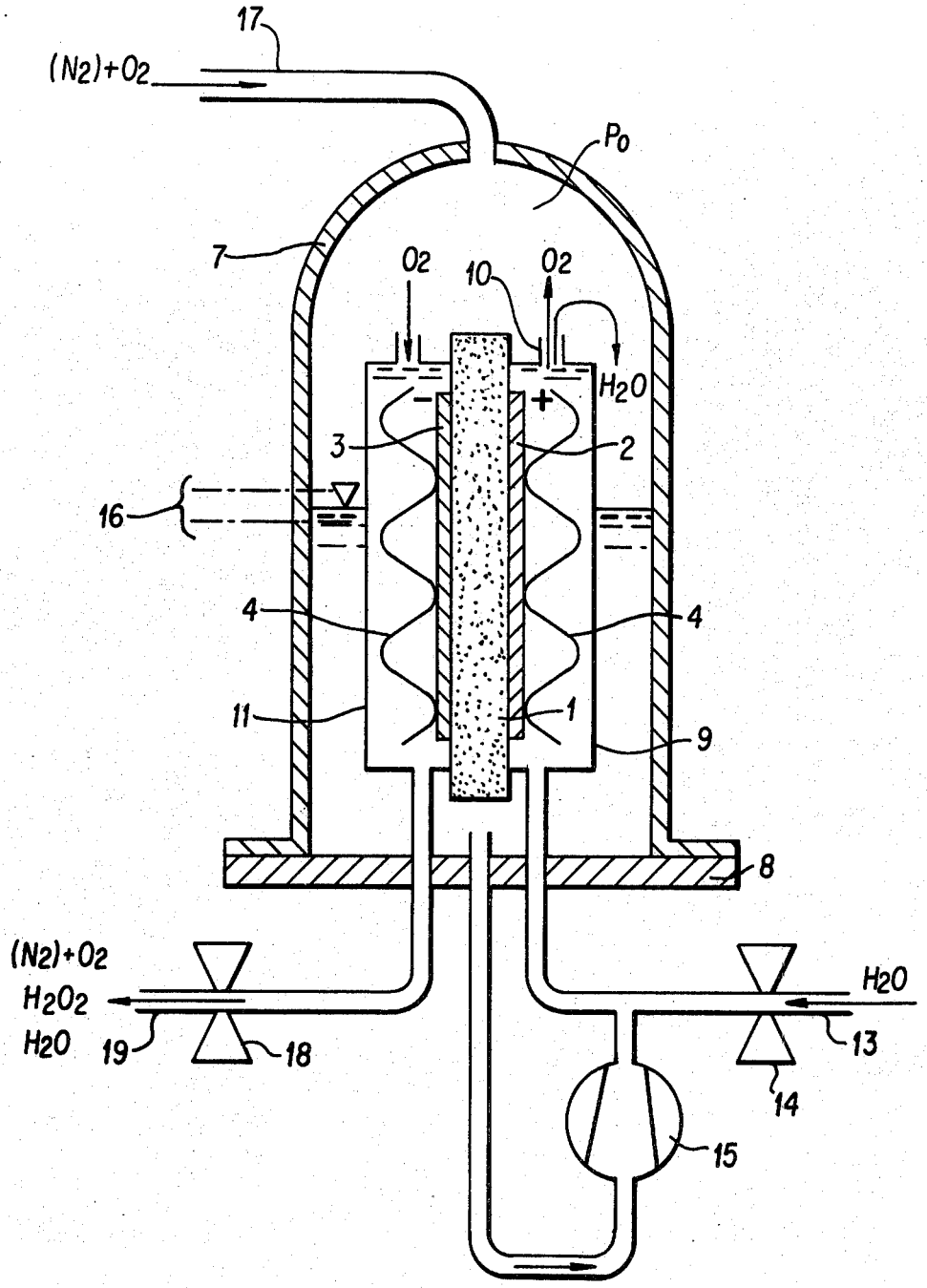

The invention is described below by means of embodiments which are illustrated by figures, of which FIG. 1 shows in diagrammatic section the principle plan of an electrolytic cell, and the associated processes, FIG. 2 shows the functional diagram of an electrolytic cell for a first variant of the process, FIG. 3 shows the functional diagram of an electrolytic cell for another variant of the process, FIG. 4 shows the functional diagram of an electrolytic cell for a process variant which uses an NaOH solution, FIG. 5 shows the functional diagram of an electrolytic cell for a process variant which uses an NaCl solution, and FIG. 6 shows a section through the diagrammatic plan of an electrolysis device for preparing $H_2O_2$.

FIG. 1 depicts a section through the principle plan of a cell suitable for $H_2O_2$ production and its method of working. 1 is the solid electrolyte which is based on the conduction of $H_3O^+$ or $OH^-$ ions and which is preferably an ion exchange membrane in the form of a plastic film. A perfluorinated polymer having sulfonic acids as ion-exchanging groups is advantageously used for this purpose. Since the solid electrolyte, unlike conventional cells of this design, does not have to perform the gas-separating function but merely has to separate the electrodes of opposite polarity, i.e. keep them a certain minimum distance apart to avoid short circuits, and also serves to conduct the ions, this plastic film can be very thin. It may also be porous, i.e. gas-permeable. An example of a suitable material which can be used is a Du Pont product known under the tradename of "Nafion". The solid electrolyte 1 carries on the positive side, the side marked with +, a gas-permeable electrically conductive coating 2 which acts as the anode, and on the negative side, the side marked with −, a coating 3 which has similar properties and acts as the cathode. The coating 2, which acts as the anode, is advantageously embodied as an electrocatalyst based on platinum metals, platinum metal oxides or mixtures thereof, preferably as an $IrO_2/RuO_2$ layer. In the case of an $OH^-$-conducting electrolyte, this coating would preferably consist of NiO. On the other hand, the coating 3, which acts as the cathode, needs to consist of a material which gives catalyst support to the reduction of $O_2$ to $H_2O_2$, and candidates for such a material include in particular activated substances containing elementary carbon (for example charcoal powder) and certain metal chelates. The 4s represent the current supply components (current collectors) which are arranged on either outside face of the coatings 2 and 3 and which can be embodied as corrugated perforated metal sheets, metal grids or woven metal fabrics. 5 is a source of direct current having a voltage of U. FIG. 1 also shows the directions of flow of incoming $H_2O$ and outgoing $H_2O_2$ (as an aqueous solution) as well as, symbolically, the $\frac{1}{2}$ $O_2$ supplied from the outside, in the correct stoichiometric proportions (indicated by arrows). In practice, however, it will be technically necessary to supply $O_2$ in more than the stoichiometric amount. The drawing also shows, on the positive side, the resulting $\frac{1}{2}$ $O_2$ and, on the negative side, the consumed $\frac{1}{2}$ $O_2=\frac{1}{2}$ $O_2$, and, in the interior of the solid electrolyte 1, the $2H^+$ migrating through the membrane. The $2e^{31}$ electron flows are also marked by arrows on the anode as well as on the cathode side.

FIG. 2 depicts the functional diagram of an electrolytic cell for a first variant of the process for preparing $H_2O_2$. The reference numbers 1 to 4 correspond exactly to those of FIG. 1. The $\frac{1}{2}$ $O_2$ gas stream supplied from the outside and the $\frac{1}{2}$ $O_2$ gas stream formed on the anode side, passed round the solid electrolyte 1 and supplied to the cathode side are drawn as appropriate arrows. The meaning of the remaining symbols is clear from analogy with FIG. 1.

FIG. 3 shows the functional diagram of an electrolytic cell for a second variant of the process for preparing $H_2O_2$. The reference numbers 1 to 4 correspond exactly to those of FIG. 1. In FIG. 3, the solid electrolyte 1 is embodied as a gas-permeable membrane. The $\frac{1}{2}$ $O_2$ gas stream supplied from the outside, the $\frac{1}{2}$ $O_2$ gas stream formed on the anode side and/or the two, combined gas streams permeating through the solid electrolyte 1 are drawn in the figure in the stoichiometrically correct ratio and are marked with arrows. The meaning of all remaining symbols is as drawn in FIG. 1.

FIG. 4 shows the functional diagram of an electrolytic cell for a variant of the process for preparing $H_2O_2$ which starts from an aqueous NaOH solution. The reference numbers 1 to 4 correspond exactly to those of FIG. 1. The $\frac{1}{2}$ $O_2$ gas stream supplied from the outside and the $\frac{1}{2}$ $O_2$ gas stream formed on the anode side, passed round the solid electrolyte 1 and supplied to the cathode side are drawn as appropriate arrows. This illustration has been based on a 2-molar aqueous NaOH solution (marked by the 2NaOH arrow and the $H_2O$ arrow). The water and sodium ion flows permeating through the solid electrolyte 1 are drawn in the figure in the stoichiometric ratio correct for this case and are marked with arrows. The solution of $H_2O_2$ and 2NaOH formed on the cathode side is also indicated with arrows.

FIG. 5 depicts the functional diagram of an electrolytic cell for a variant of the process for preparing $H_2O_2$ which starts from an aqueous NaCl solution. The reference numbers 1 to 4 correspond exactly to those of FIG. 1. Here, the solid electrolyte 1 is embodied as a gas-tight ion exchange membrane which is continued as a separating wall 6. The anode and cathode sides are thus completely separate from each other not only in respect of liquid but also in respect of gases. The 1-molar aqueous solution supplied on the anode side is shown by the 2NaCl and $2H_2O$ arrows. The same applies to the $H_2O_2$ and 2NaOH solution formed on the cathode side. The water and sodium ion flows permeating through the solid electrolyte are also marked with arrows. This also applies to the $(O_2)+Cl_2$ gas stream formed on and to be conducted away from the anode side and to the $O_2$ gas stream to be externally supplied to the cathode side.

FIG. 6 shows a section through the diagrammatic plan of an electrolysis device for preparing $H_2O_2$. The components corresponding to the reference numbers 1 to 4 are identical to those of FIG. 1. 7 is a pressure vessel mounted in a water- and gas-tight manner on a base plate 8 and intended for receiving the electrolytic cell in a narrower sense.

The cell has on the positive side a space which is sealed on all sides, namely the anode chamber 9 which is provided at the top with an overflow pipe 10 for $H_2O$ and $O_2$. On the opposite side of the solid electrolyte 1 there is an analogous sealed space, namely the cathode chamber 10 which has an opening at its upper front end, namely the inflow pipe 12 for $O_2$ or an oxygen-containing gas, for example air $(O_2+N_2)$.

13 is the water supply line (feed), and 15 is a circulation pump for the water. The water level in the pressure vessel 7 is regulated by a level controller 16 (symbolically drawn) which is controlled by a regulating valve 14. 17 is the supply line for the oxygen or the oxygen-containing gas (for example air), which is marked by the symbol $(N_2)+O_2$. 18 represents a vlave for maintaining a constant pressure ($p_o$) in the pressure vessel 7, and 19 represents the $H_2O_2$ offtake line (withdrawal) which also holds the solvent, $H_2O$, and excess oxygen-containing gas, $(N_2)+O_2$. Each direction of flow is marked by a arrow.

MODE OF OPERATION

See FIGS. 1 to 5.

The electrochemical cell for preparing hydrogen peroxide, which essentially consists of the solid electrolyte 1 and the coatings 2 and 3 which act as electrodes, is basically designed for reducing oxygen by nascent hydrogen to $H_2O_2$. In the course of this overall process, the following reactions take place at the electrodes on the assumption of ideal conditions and complete conversion:

Anode: decomposition of water:

$$H_2O \rightarrow \frac{1}{2}O_2 + 2H^+ + 2e^-$$

Cathode: reduction of oxygen:

$$O_2 + 2H^+ + 2e^- \rightarrow H_2O_2$$

It is thus important to ensure that 1 mole of oxygen is present at the cathode per conversion. $\frac{1}{2}$ $O_2$ needs therefore to be supplied from outside the cell, which is symbolically indicated in FIG. 1 by a arrow pointing obliquely downwards drawn on the cathode side. The other half amount of oxygen to correspond to $\frac{1}{2}$ $O_2$ originates from electrolysis on the anode (arrow pointing vertically upwards) and needs also to be brought to the cathode side in some way.

This can in principle—always assuming ideal conditions—be effected in two different ways:

In FIG. 2 one half of the oxygen, $\frac{1}{2}$ $O_2$, is passed direct from the outside to the cathode side. The other half amount of oxygen, i.e. the nascent oxygen $\frac{1}{2}$ $O_2$ formed at the anode is passed round the solid electrolyte 1 and again to the cathode side. There the total available oxygen, $\frac{1}{2}$ $O_2+\frac{1}{2}$ $O_2$, is reduced to $H_2O_2$.

In FIG. 3 the anode side of the cell is supplied with a mixture of $H_2O$ and $\frac{1}{2}$ $O_2$. In addition, nascent oxygen $\frac{1}{2}$ $O_2$ is formed on this side. Both the amounts of oxygen, i.e. $\frac{1}{2}$ $O_2+\frac{1}{2}$ $O_2$, are made to migrate through the porous, gas-permeable solid electrolyte 1 by keeping the anode side in this embodiment under a slight overpressure compared with the cathode side. Again the result is 1 mole of $H_2O_2$ due to the reduction of oxygen on the cathode side.

It should be pointed out especially that, in both cases, pure $H_2O_2$ is formed in an aqueous solution free of any other chemicals. There is no need to separate off any electrolysis components, as is the case with the use of liquid electrolytes. The product formed can be used direct in many domestic, commercial and industrial sectors.

If it is desired, for any reason, not to produce a more or less neutral solution of hydrogen peroxide in water but a basic solution, for example an alkaline solution, this can be effected, as in the case of a solution with NaOH, in two different ways:

In FIG. 4 the anode side of the cell is supplied with a mixture of water and sodium hydroxide (for example, a 2-molar solution of NaOH which corresponds to $H_2O+2NaOH$) in place of pure water, and produces $\frac{1}{2}$ $O_2$ which is passed round the solid electrolyte 1 to the cathode side. The positive $2Na^+$ ions migrate through the solid electrolyte 1, as does $H_2O$. On the cathode side, NaOH is immediately re-formed by a reaction of $Na^+$ with $H_2O$. To produce $H_2O_2$, an additional $\frac{1}{2}$ $O_2$ needs to be supplied to the cathode side from the outside. In practice, aqueous solutions of at most 1 mole of NaOH will be used.

Since essentially only oxygen or oxygen-containing gases which are free of any other chemically active component (for example air) appear both on the anode side and on the cathode side, this process can of course also be carried out by means of a gas-permeable solid electrolyte 1 analogous to FIG. 3.

In FIG. 5 the anode side of the cell is supplied with a mixture of water and sodium chloride (for example a 1-molar solution of NaCl which corresponds to $2H_2O+2NaCl$) in place of pure water, and produces $Cl_2$ and, in certain circumstances, ($O_2$), which needs to be removed from the anode space. In this case the solid electrolyte 1 must not be gas-permeable and the cathode side must be separated from the anode side by the additional separating wall 6. In this case the cathode side needs to be supplied from the outside with the full amount of oxygen, $O_2$, necessary for forming $H_2O_2$ and 2NaOH. In practice aqueous solutions of at most 1 mole of NaCl will be used.

It is of course also possible to conceive of combinations of reactions of $H_2O$ and an alkali metal compound other than those shown in FIGS. 4 and 5. The conditions depend merely on the concentrations of $H_2O_2$ and, for example, NaOH in $H_2O$ desired on the withdrawal side (cathode side).

With reference to the functional diagrams, it should be stressed once more that the new process is not tied in any way to particular liquid electrolytes and can be carried out entirely without any slat concentrations or additional base or acid contents. In the preceding variants of FIGS. 4 and 5, the Na compound does not function primarily as an electrolyte, although the $Na^+$ ions contribute to conductivity. The FIG. 5 example basically represents a combination of an electrolytic cell for producing $H_2O_2$ with a chlorine/alkali cell.

ILLUSTRATIVE EMBODIMENT I

See FIGS. 1, 2 and 6.

The electrolytic cell used for carrying out the process had as solid electrolyte 1 a membrane made of a perfluorinated polymer having sulfonic acids and bearing the Du Pont tradename "Nafion 120". On the positive side this Nafion film had been provided with a gas-permeable mixed noble metal oxide coating 2 (in this case corresponding to the formula $(Ru_{0.5}\ Ir_{0.5})O_2$) which acted as the anode. On the negative side, the cathode consisted of a gas-permeable coating 3 in the form of a graphite layer. The current was supplied by the current collectors 4, which were on the anode side a porous sintered titanium foil and on the cathode side nickel wire mesh. The cell was enclosed in and held together by two titanium frames forming the anode chamber 9 and the cathode chamber 11. To pass the various operating media in and out, each frame had an opening in the lower as well as in the upper front end. More particularly, the upper part of the anode chamber 9 had an overflow pipe 10 for $H_2O$ and $O_2$ and the cathode chamber 11 had an inflow pipe 12 for $O_2$ or $O_2+N_2$. The anode chamber 9 was fed with completely demineralized water at 80° C. through the water supply line 13 (feed) and the regulating valve 14. The cathode chamber 11 was supplied through the pipe connection 12 with a moistened $O_2$ stream at about 1 liter/hour. A direct current source 5 was then connected to the current collectors 4 of the cell. The voltage U was gradually increased. At a voltage of about 1 V, the current increased. At a voltage of 1.4 V, a current density of 10 $mA/cm^2$ became established. The water transported by the current flow through the solid electrolyte 1 was collected in the cathode chamber 11 and analyzed for its $H_2O_2$ content by means of a decoloration reaction of a solution of permanganate. An $H_2O_2$ concentration of 3% by weight in water is generally likely.

ILLUSTRATIVE EMBODIMENT II

See FIG. 6.

A cell of the Example I was built into a gas-tight pressure vessel 7 sealed at the bottom by a base plate 8. The openings in the lower front ends of anode chamber 9 and of cathode chamber 12 were passed through the base plate 8 and connected to the water supply line 13 and the $H_2O_2$ offtake line 19 (withdrawal) respectively. The two pipe connections 10 and 12 at the upper front ends of chambers 9 and 11, on the other hand, were left open toward the unwetted, upper space of pressure vessel 7. The pressure vessel 7 was then filled to the mark of the level controller 16 by feeding water in through the water supply line 13 and the regulating valve 14. The entire pressure vessel 7 was then put under a pressure, $p_o$, of 10 mPa not only on the gas but also on the water side. The pressure constancy valve 18 ensured that this pressure ($p_o$) was maintained. In pressurizing the pressure vessel, the oxygen-containing gas supplied via line 17 (in the present case compressed air, $N_2+O_2$) and the water fed in through line 13 need of course also to be supplied to the device at least under this pressure. The device was then set in operation by connecting a current source (cf. 5 in FIG. 1) to the current collectors 4 and switching on the circulation pump 15. A current density of 100 $mA/cm^2$ was achieved at a direct voltage of 1.4 V and a controlled compressed air supply of 0.5 liter/hour. The $H_2O_2$ content of the withdrawn aqueous solution was on average 3% by weight.

The invention is not restricted to the illustrative embodiments. More particularly, the process can also be carried out with starting materials other than pure water and oxygen or air. It is in fact largely independent of the salt concentration of the starting solution. The choice of appropriate media, be they more or less pure water, aqueous salt solution or alkaline or some other basic solution, is solely determined by the desired end product and/or its suitability for use: for example from tap-water to brackish water of up to a 5 g/l salt content.

I claim:

1. A process for the electrochemical production of hydrogen peroxide, $H_2O_2$, in an electrochemical cell from water or from an aqueous solution and oxygen, which comprises using a $H_3O^+$— or $OH^-$—conducting solid electrolyte (1) as electrolyte, using porous, gas-permeable electrically conductive coatings (2, 3) as electrodes, supplying the solid electrolyte with water on the anode side and with an oxygen-containing gas or pure oxygen on the cathode side, and withdrawing on the cathode side $H_2O_2$, wherein the $H_2O_2$ is the reaction product of $O_2$ supplied to the cathode and $H^+$ ions which are liberated at the anode and pass through the solid electrolyte to react at the cathode.

2. The process of claim 1, wherein the solid electrolyte (1) is an ion exchange membrane in the form of a polymer film made of a type of perfluorinated polymer having sulfonic acids and have, on one side, a gas-permeable $IrO_2/RuO_2$-based electrocatalyst coating (2) which acts as the anode and, on the other side, a gas-permeable coating (3) which is based on charcoal powder and acts as the cathode, and a grid- or fabric-like current collector (4) for supplying current is provided at least on the cathode side.

3. The process of claim 1, wherein the oxygen supplied from the outside as well as the anode-produced oxygen are passed to the immediate vicinity of the cathode while largely circumventing the solid electrolyte (1).

4. The process of claim 1, wherein the solid electrolyte (1) used is a porous, gas-permeable ion exchange membrane and the oxygen supplied from the outside is passed together with the water to the anode side of the cell and is passed under overpressure together with the anode-produced oxygen to the cathode side through the porous solid electrolyte (1).

5. The process of claim 1, wherein the electrolytic cell is inside a pressure vessel (7) which is under the pressure $p_o$ and sealed off with a base plate (8), consists of a solid electrolyte (1), gas-permeable coatings (2, 3) and current collectors (4) and has an anode chamber (9) with an overflow pipe (10) for water and oxygen and a cathode chamber (11) with an inflow pipe (12) for oxygen or an oxygen-containing gas is supplied on the anode chamber (9) side through a water supply line (19) with water which is kept in continuous circulation by means of a circulation pump (15), the oxygen supplied from the outside or the oxygen-containing gas is passed through a line (17) into the wetted or unwetted interior space of the pressure vessel (7), the oxygen produced in the anode chamber (9) is passed through the overflow pipe (10) into the upper, unwetted space of the pressure vessel (7), the entire oxygen is forced through the said unwetted space into the cathode chamber (11) of the cell in which the same pressure is maintained on the anode side and on the cathode side, the water level in the pressure vessel (7) is kept within any desired narrow limits by a level controller (16) controlling a regulating valve (14) in the water supply line (13), and, finally, the product withdrawn from the cell through an offtake line (19) provided with a pressure constancy valve (18) is an aqueous solution of hydrogen peroxide which can also contain some oxygen and/or atmospheric nitrogen.

* * * * *